United States Patent [19]

Miyagi et al.

[11] 4,364,363

[45] Dec. 21, 1982

[54] ELECTRONICALLY CONTROLLING, FUEL INJECTION METHOD FOR INTERNAL COMBUSTION ENGINE

[75] Inventors: Hideo Miyagi; Jiro Nakano, both of Okazaki, Japan

[73] Assignee: Toyota Jidosha Kogyo Kabushiki Kaisha, Toyota, Japan

[21] Appl. No.: 150,353

[22] Filed: May 16, 1980

[30] Foreign Application Priority Data

Jan. 18, 1980 [JP] Japan ..... 55-3674

[51] Int. Cl.[3] ..... F02D 5/00

[52] U.S. Cl. ..... 123/492; 123/483; 123/494

[58] Field of Search ..... 123/492, 491, 494, 483, 123/493

[56] References Cited

U.S. PATENT DOCUMENTS

| | | | |
|---|---|---|---|
| 3,593,692 | 7/1971 | Scholl et al. | 123/492 |
| 3,759,231 | 9/1973 | Endo | 123/492 |
| 4,227,507 | 10/1980 | Takase et al. | 123/493 |
| 4,266,275 | 5/1981 | Marchak | 123/492 |

*Primary Examiner*—Charles J. Myhre
*Assistant Examiner*—Andrew M. Dolinar
*Attorney, Agent, or Firm*—Cushman, Darby & Cushman

[57] ABSTRACT

According to the present invention, an amount of fuel being supplied to an internal combustion engine during acceleration is controlled in association with a desired value of acceleration (a degree of acceleration) and a temperature of the engine. The amount of fuel being supplied increases, as the desired value of acceleration is increased, and as the engine temperature becomes lower. Thus, an engine output necessary for rapid acceleration is positively provided, with the assurance of a desirable driving feeling at slow acceleration.

18 Claims, 15 Drawing Figures

ELECTRONICALLY CONTROLLING, FUEL INJECTION METHOD FOR INTERNAL COMBUSTION ENGINE

BACKGROUND OF THE INVENTION

1. Field of the Invention

This invention relates to an electronically controlled, fuel injection method for an internal combustion engine, wherein an amount of fuel being supplied to an internal combustion engine is adjusted by controlling an electric signal to a fuel injection valve provided in an intake system of the engine.

2. Description of Prior Arts

In a prior art electrically controlled, fuel injection method, it is usual that the rate at which fuel is increased during acceleration is dependent only on a cooling-water temperature in the internal combustion engine, irrespective of a desired value of acceleration. If the aforesaid rate at which fuel is increased corresponds to a slow acceleration, there results a shortage in an amount of fuel being supplied during rapid acceleration, and if the aforesaid rate is adapted to correspond to a rapid acceleration, during a slow acceleration an over-rich mixture occurs, thus leading to a bad operating feeling, an increased fuel consumption and scorched ignition plugs.

SUMMARY OF THE INVENTION

It is an object of the present invention to provide an electronically controlled, fuel injection method for an internal combustion engine, wherein an optimum amount of fuel is consistently supplied into combustion chambers, irrespective of a desired value of acceleration, so as to eliminate a shortage of fuel during rapid acceleration, as well as to provide a smooth operating feeling for an operator at slow acceleration.

To attain the object, the amount of fuel being supplied into combustion chambers during acceleration is corrected in accordance with both a degree of acceleration and the temperature of an engine, the first of which is dependent on a throttle-valve opening velocity or an increasing rate of intake air.

The larger the desired value of acceleration and the lower the internal combustion engine temperature, the larger the amount of fuel being supplied at the acceleration. Thus, an engine output necessary for the rapid acceleration is established. The good operating feeling at the slow acceleration is ensured and fuel consumption at the slow acceleration is reduced so that ignition plug scorching during slow acceleration is eliminated.

A desired value of acceleration is detected according to a change in a degree of opening of a throttle valve in the intake system.

A throttle sensor comprises a pair of conductors respectively having equally spaced plural comb-teeth of one conductor opposing in a staggered relation to those of the other conductor, so that when a throttle valve in the intake system is turned to an open position, a conductor portion moving integrally with a rod of the throttle valve contacts the comb-teeth of the pair of conductors alternately. The pair of conductors are connected to two input terminals of a flip-flop which forms a first input stage of an acceleration pulse generating circuit. When one of the conductors is maintained in contact with the conductor portion through the medium of the tooth thereof, a voltage at one terminal of the flip-flop becomes "0", and when the aforesaid conductor is out of contact with the conductor portion, a voltage thereat is inverted to "1". Increase in a degree of acceleration, namely increase in a desired value of acceleration reduces an interval of time at which input signals at input terminals of the flip-flop are inverted from one condition to another.

Only when a desired value of acceleration is larger than a predetermined value, an amount of fuel being supplied is increased for acceleration. Thus, an unwanted increase in an amount of fuel being supplied is avoided in the event of a change in a degree of opening of the throttle valve in the usual running modes of the engine, except for the acceleration.

Whether or not the desired value of acceleration is larger than a predetermined value is detected by a variation in a voltage in the pair of conductors, on the basis of an interval of time at which input signals at the input terminals of the flip-flop are inverted. Only when an interval of time from inversion of voltage at one input terminal of the flip-flop until inversion of voltage at the other input terminal thereof is less than a predetermined value, an acceleration pulse is provided at the voltage inverted time at the other input terminal of the flip-flop.

In order to detect whether or not this interval of time is less than a predetermined value, two outputs of the flip-flop are provided to monostable multivibrators, respectively, for calculating the logical sum of the output of one monostable multivibrator, to which one output terminal of the flip-flop is connected, and the other output of the flip-flop. An amount of fuel injected per cycle of injection by a fuel injection valve is sorted into a portion independent of the acceleration and a portion increased at the acceleration, which is dependent on the acceleration. For a duration which no acceleration pulse appears, the increased portion decreases with a given gradient, with the lapse of time. The increased portion is thus rapidly decreased to zero upon termination of acceleration.

The increased portion discontinuously increases by a given amount relating to an engine temperature every time the acceleration pulse generates. The increased portion thus increases as an acceleration pulse period decreases, stated otherwise, as a desired value of acceleration increases.

The desired value of acceleration may be detected by a change in an output of a potentiometer, which generates a voltage related to a position of the rotating shaft of the throttle valve in the intake system.

An output of the potentiometer is detected at intervals of a given time, and only when a value obtained by subtracting the output generated in a succeeding step from the output generated in a preceding step is larger than a predetermined value, an amount of fuel being supplied for acceleration is increased.

If the result of subtraction is larger than a predetermined value, the increased portion discontinuously increases by a predetermined increasing portion proportional to the result of subtraction.

The desired value of acceleration can also be detected according to a variation in an amount of intake air. A voltage relating to a flow rate of intake air is detected, and the voltage thus detected is processed in like manner as the output of the potentiometer interlocking with the shaft of the throttle valve, thereby detecting the target value of acceleration.

DETAILED DESCRIPTION OF PREFERRED EMBODIMENTS

Figure 1:
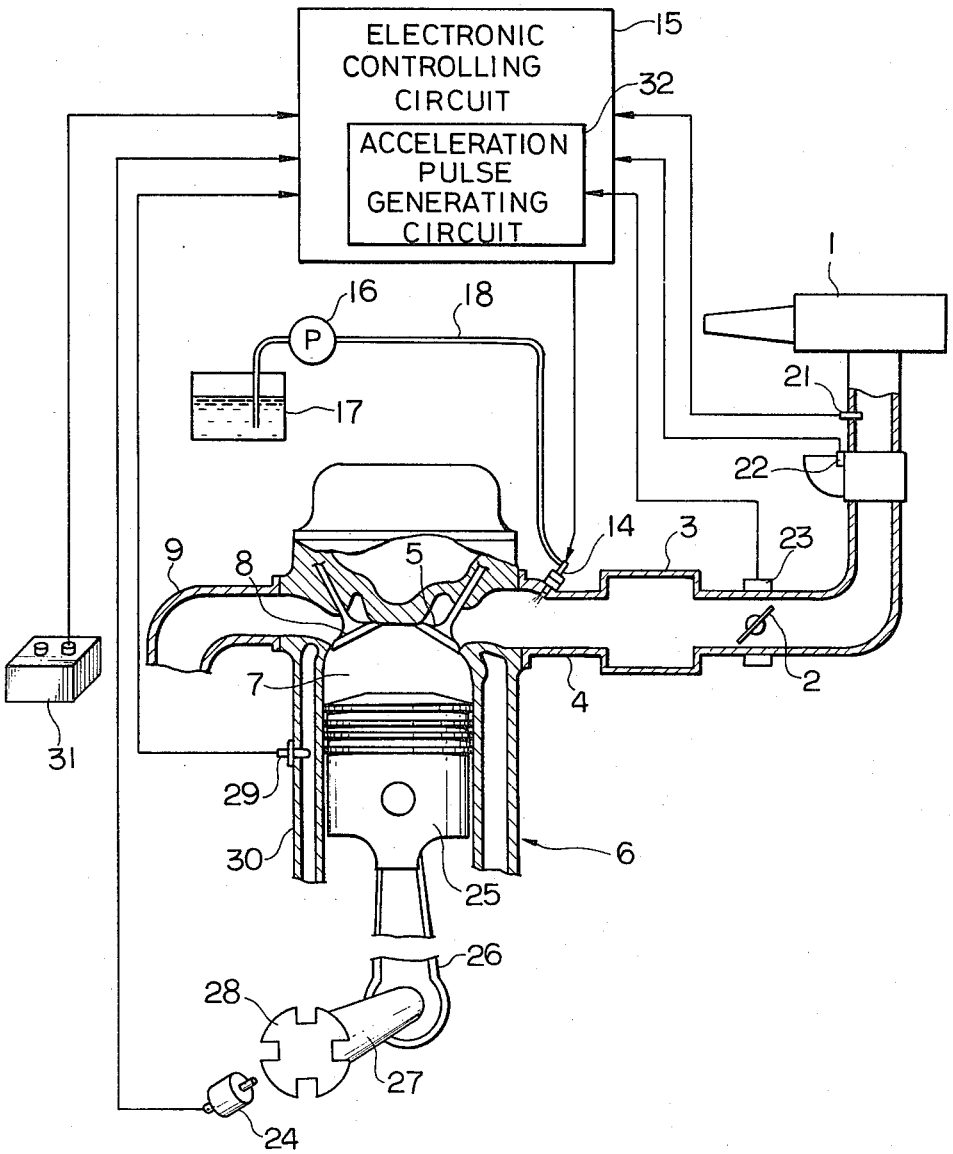
FIG. 1 is a schematic view of an internal combustion engine embodying an electrically controlling fuel injection method according to the present invention.

FIG. 1 is a schematic view of an internal combustion engine embodying the electronically controlled, fuel injection method of the present invention. Intake air introduced under suction from an air cleaner 1 into an intake passage is supplied via a surge tank 3, an intake manifold 4 and an intake valve 5 into a combustion chamber 7 in the engine body 6, while a flow rate thereof is controlled by a throttle valve 2. An air-fuel mixture burned in the combustion chamber 7 is discharged as exhaust gases through an exhaust valve 8 and an exhaust manifold 9. A fuel-injection valve 14 is provided in the intake manifold 4 in a manner to face respective combustion chambers. A duration for which the fuel-injection valve 14 is maintained at an open position and a timing at which the valve is turned to an open position are controlled by electric signals from an electronic controlling circuit 15. The fuel-injection valve 14 thus injects fuel into the intake system which is supplied under pressure from a fuel tank 17 by way of a conduit 18 by means of a fuel pump 16.

An intake air temperature sensor 21 is provided in the intake passage so as to detect a temperature of intake air. An air flow meter 22 detects a flow rate of intake air. A throttle sensor 23 detects a throttle-valve opening speed. In order to detect a crank angle of the crank shaft 27, a crank-angle sensor 24 produces a pulse in association with rotation of a notched member 28 attached to a crank shaft 27 which is coupled to the lower end of a connecting rod 26, which in turn is coupled to a piston 25. A water-temperature sensor 29 is attached to a water jacket 30 so as to detect the cooling water temperature, in order to provide information of an engine temperature. The outputs of the intake air temperature sensor 21, air flowmeter 22, throttle-sensor 23, crank-angle sensor 24 and water-temperature sensor 29 are provided to the electronic controlling circuit 15. The output of the throttle sensor 23 is processed in an acceleration pulse generating circuit 32 of the electronic controlling circuit 15. Furthermore, information on a voltage of a battery 31 is fed to the electronic controlling circuit 15.

Figure 2:
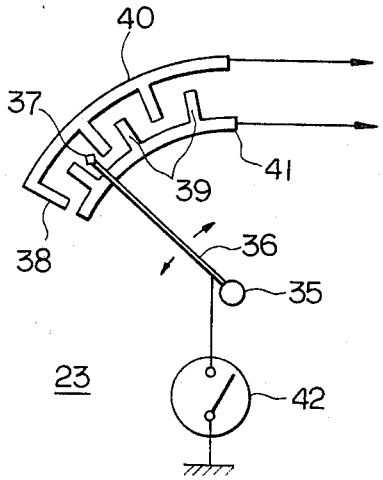
FIG. 2 illustrates a throttle sensor in detail.

FIG. 2 illustrates the detailed throttle-sensor 23. The throttle-sensor 23 comprises a conductor rod 36 rotating integrally with a rod 35 of the throttle valve 2, a pair of conductors 40 and 41 respectively having equally spaced plural comb-teeth, and a switch 42 adapted to be turned to a closed position only when the throttle valve 2 is turned to an open position, thereby connecting the conductor rod 36 to ground, the aforesaid pair of conductors being disposed in a manner that the equally spaced plural comb-teeth of one conductor oppose in a staggered relation the comb-teeth of the other conductor, so that when the conductor rod 36 is rotated, the free end 37 of the rod comes into contact with the comb-teeth of the pair of conductors alternately. The switch 42 is adapted to open when the throttle valve 2 is turned to a close position.

Figure 3:
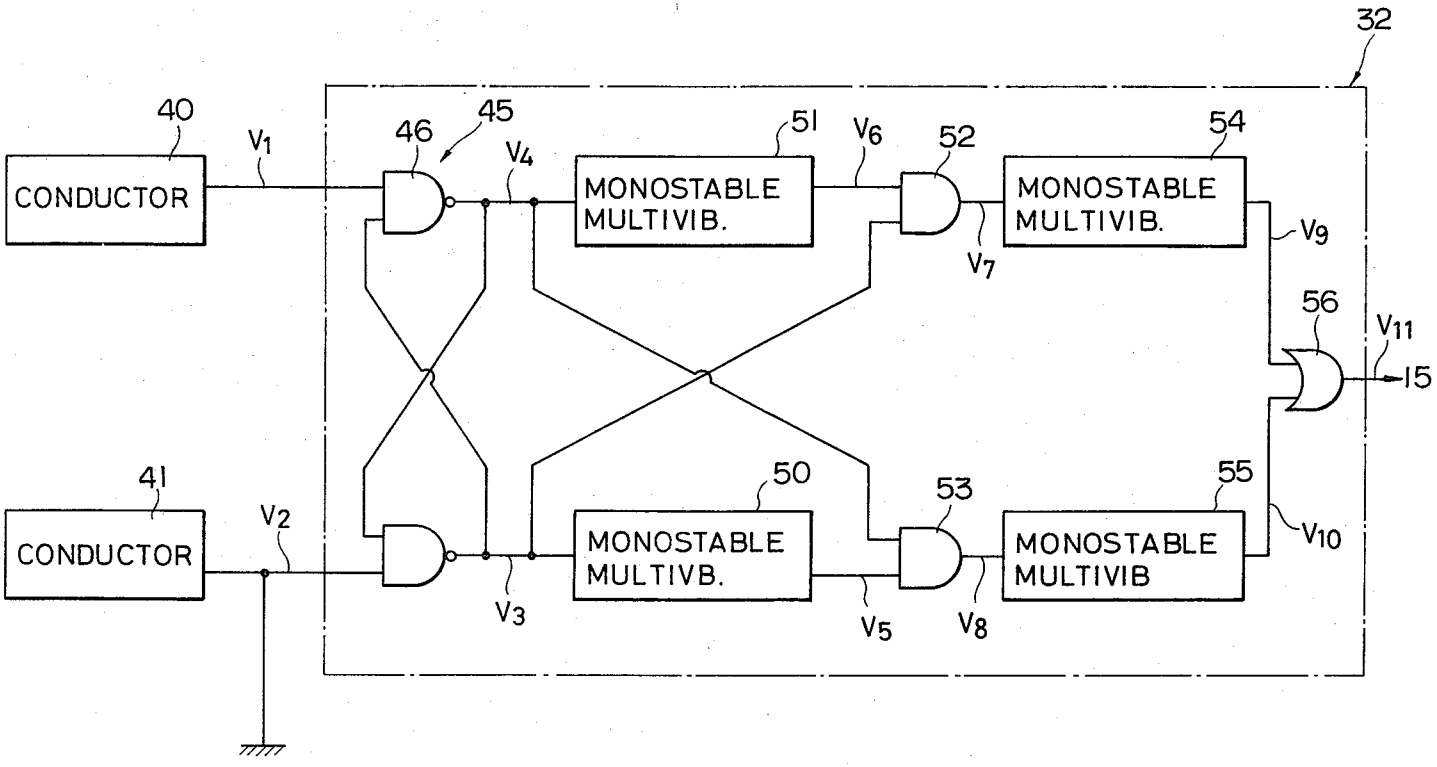
FIG. 3 is a block diagram of an acceleration pulse generating circuit.
Figure 4:
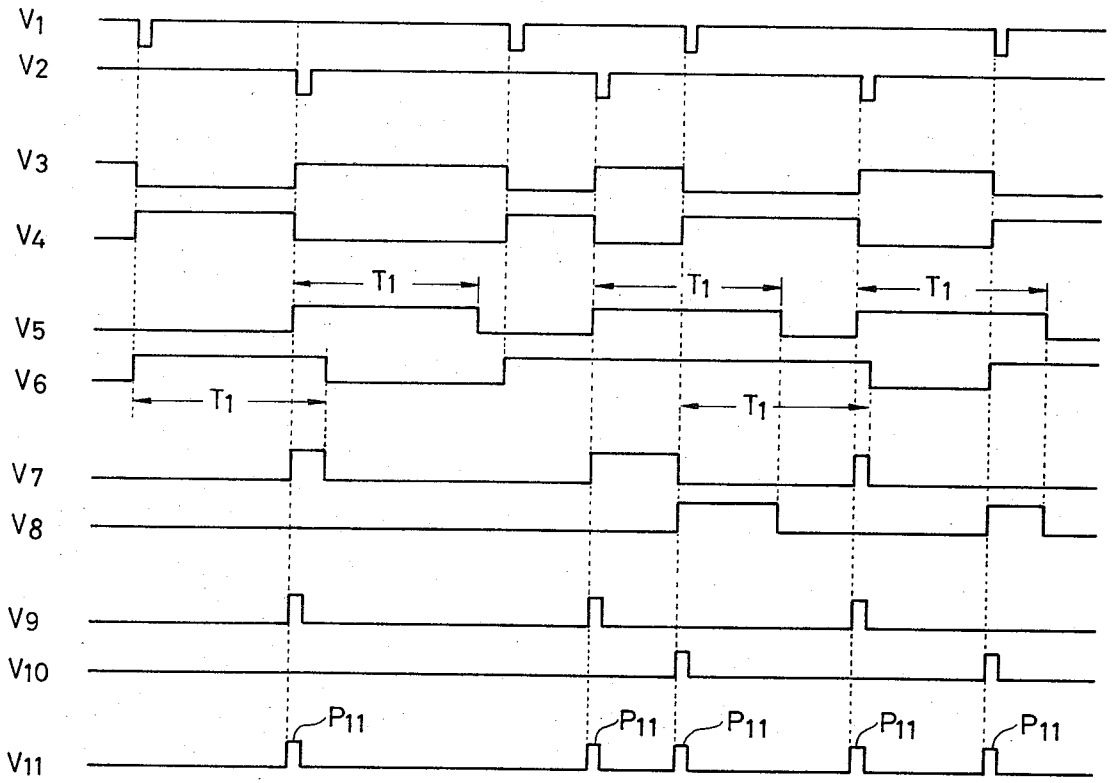
FIG. 4 is a timing chart in the acceleration pulse generating circuit.

FIG. 3 illustrates the detailed acceleration pulse generating circuit 32, and FIG. 4 shows voltage waveforms in respective portions in FIG. 3. The abscissa in FIG. 4 represents a time t. The pair of conductors 40 and 41 are connected to two input terminals of a RS flip-flop 45 composed of two NAND circuits 46 and 47, respectively. When the end 37 of the conductor rod 36 of the throttle sensor 23 is in contact with the comb-teeth 38 or 39, one of the input terminals of the RS flip-flop 45, namely a portion V1 or V2, is grounded and maintained at a voltage level "0" (a lower voltage is defined as "0", and a higher voltage as "1" hereinafter.). When the end 37 is out of contact with the tooth, the portion V1 or V2 is rendered open and maintained at a voltage "1". A short interval of time between the voltage "0" at the portion V1 and the voltage "0" at the portion V2 signifies that the throttle-valve opening-speed is rapid, and hence acceleration is rapid. When a voltage at the portion V1 becomes "0", the output terminals of the RS flip-flop 45, namely, portions V3 and V4, are maintained at "0" and "1", respectively, until a voltage at the portion V2 is inverted to "0". On the other hand, when a voltage at the portion V2 becomes "0", then the portions V3 and V4 are maintained at "1" and "0", respectively, until a voltage at the portion V1 in turn is inverted to "0". The portions V3 and V4 are connected to input terminals of retriggerable monostable multivibrators 50 and 51, respectively. For a given duration of time after the voltage at the portion V3 or V4 has been inverted from "0" to "1", the output terminals of the monostable multivibrators 50 and 51, namely, portions V5 and V6, are maintained at "1". The portions V3 and V6 are connected to input terminals of an AND circuit 52, and the portions V4 and V5 are connected to input terminals of an AND circuit 53. When the portions V3 and V6 remain at "1", the output terminal of the AND circuit 52, namely a portion V7, is maintained at "1". When the portions V4 and V5 both remain at "1", the output terminal of the AND circuit 53, namely, a portion V8, is maintained at "1". The portions V7 and V8 are connected to monostable multivibrators 54 and 55 serving as differential circuits, respectively. When the portion V7 or V8 is inverted from "0" to "1", a pulse is generated at the output terminal of the monostable multivibrator 54 or 55, namely, a portion V9 or V10. The portions V9 and V10 are connected to input terminals of an OR circuit 56, so that when a pulse is generated at least at one of the portions V9 or V10, a pulse is generated at the output terminal of the OR circuit 56, namely, at a portion V11. As is obvious from FIG. 4, only when a voltage at the portion V2 or V1 is inverted to "0" within a given duration of time T1 after the voltage at the portion V1 or V2 has become "0", stated otherwise, only when the throttle-valve opening speed is larger than a given value, then an acceleration pulse P11 is generated at the portion V11.

Figure 5:
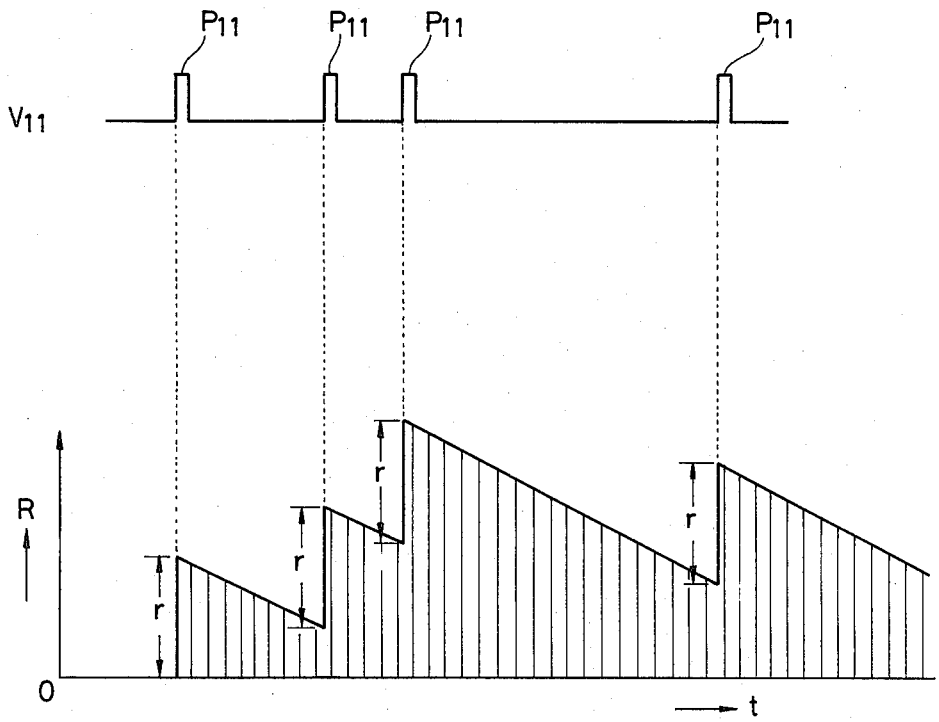
FIG. 5 is a graph representing the relationship between an acceleration pulse and a value of increased portion which is necessary for calculating an amount of fuel being injected.

An amount of fuel injected by the fuel injection valve 14 for a single open-duration thereof is divided into a portion independent of acceleration and a portion increased at the acceleration, which portion is closely related to acceleration. FIG. 5 is a conceptional graph representing the relationship between a value of increase R, which forms a basis of calculation of the aforesaid increased portion of the amount of fuel, and an acceleration pulse P11 which is an output of the acceleration pulse generating circuit 32. The value of increase R can be obtained according to a software in the central processing unit CPU in the electronic controlling circuit 15 which will be described later. The abscissa in FIG. 5 represents a time t. Simultaneously with generation of the acceleration pulse P11, the value of increase R increases a given value r discontinuously, and the value of increase R decreases at a given slope until a succeeding acceleration pulse is provided thereto. As the interval of time from generation of a preceding acceleration pulse P11 until generation of a succeeding acceleration pulse P11 is reduced, stated otherwise, as the opening speed of the throttle valve 2 increases, the value of increase R increases.

Figure 6:
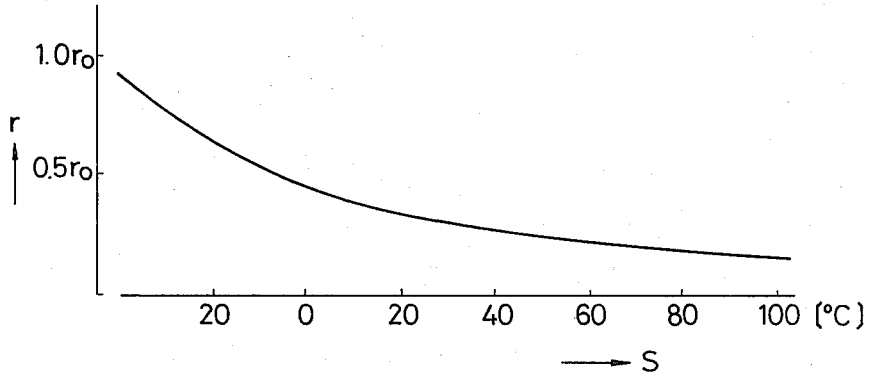
FIG. 6 plots the relationship between a predetermined increased portion r in FIG. 5 and an engine cooling-water temperature.

FIG. 6 represents the relationship between a given increased portion r of FIG. 5 and an engine cooling-water temperature S. In terms of $r_o$ being a reference value, r decreases, as the engine cooling-water temperature S is raised.

An amount of fuel supplied by the fuel-injection valve 14 in the acceleration mode of the engine increases as a desired value of acceleration increases and as the engine temperature is lowered.

Figure 7:
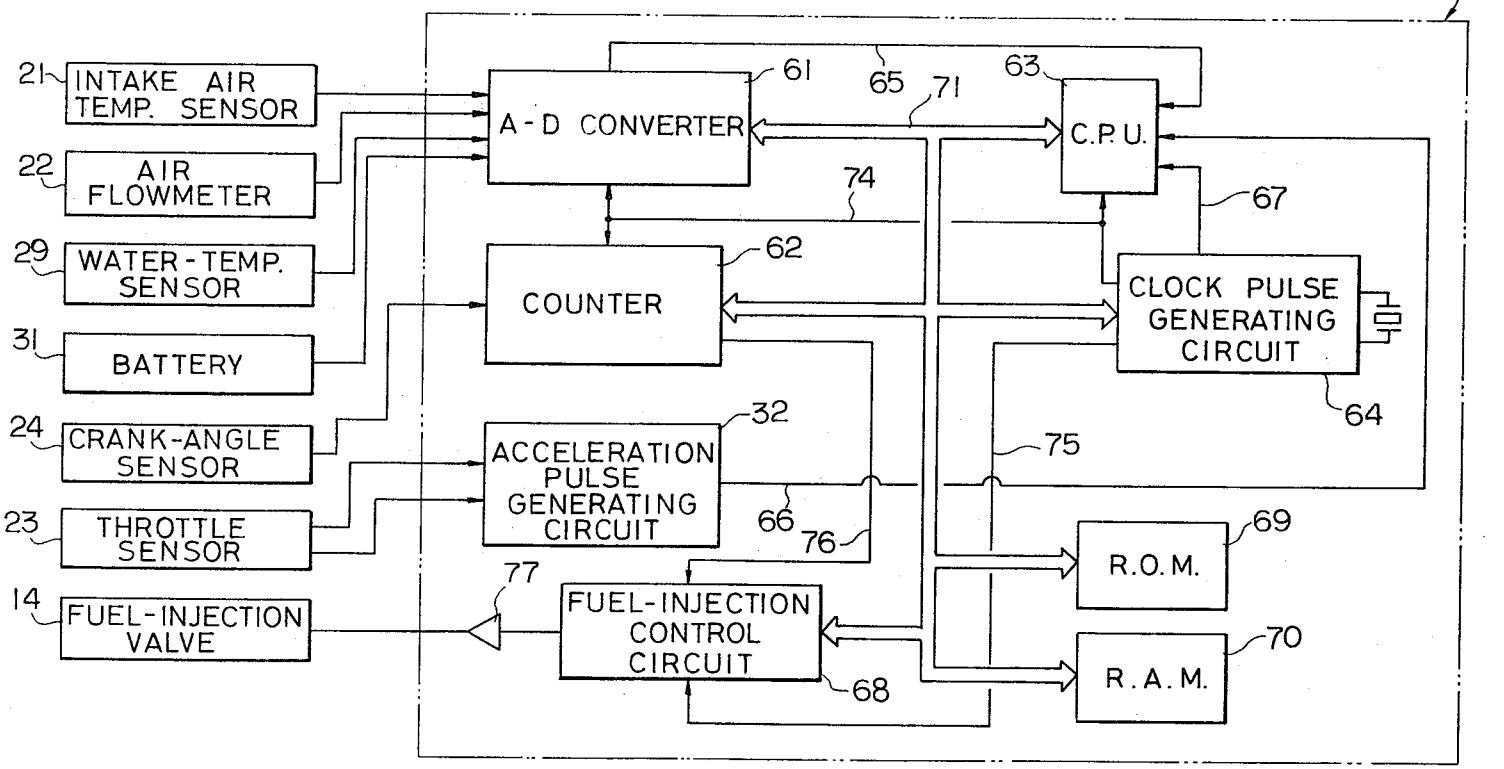
FIG. 7 is a block diagram of an electronic control circuit in FIG. 1.

FIG. 7 is a detailed block diagram of the electronic controlling circuit 15. The outputs of respective sensors 21, 22, 29 and 31 are fed to an A-D converter 61 and converted by time-division into the digital form. The output of the crank-angle sensor 24 is provided to a counter 62, so that the rpm of the engine and an injection-valve opening-motion start-timing are detected. The CPU 63 receives interrupt signals by way of lines 65, 66 and 67 from the A-D converter 61, the acceleration pulse generating circuit 32, and the clock pulse generating circuit 64, respectively. The A-D converter 61, counter 62, fuel-injection control circuit 68, CPU 63, clock pulse generating circuit 64, a read only memory (ROM) 69 and RAM (a random access memory) 70 are connected to each other by way of a bus 71. Synchronizing signals are transmitted from the clock pulse generating circuit 64 by way of a line 74 to the A-D converter 61, the counter 62 and the CPU 63, respectively. The clock pulse from the clock pulse generating circuit 64 is transmitted by way of a line 75 to the fuel-injection control circuit 68 as well. A fuel-injection start signal is provided from the counter 62 by way of a line 76 to the fuel-injection control circuit 68. The output of the fuel-injection control circuit 68 is provided by way of a power amplifier 77 to the fuel injection valve 14. The CPU 63 calculates an amount of fuel being injected per one cycle of injection by the fuel injection valve 14 based on respective informations in accordance with a program stored in the ROM 69. The result of calculation is set at a down-counter in the fuel-injection control circuit 68. The down-counter receives the fuel-injection start signal through a line 76, and subtracts 1 every time the counter receives a clock pulse via the line 75. The fuel injection valve 14 remains at the open position until the content in the down-counter 68 becomes zero.

Figure 8:
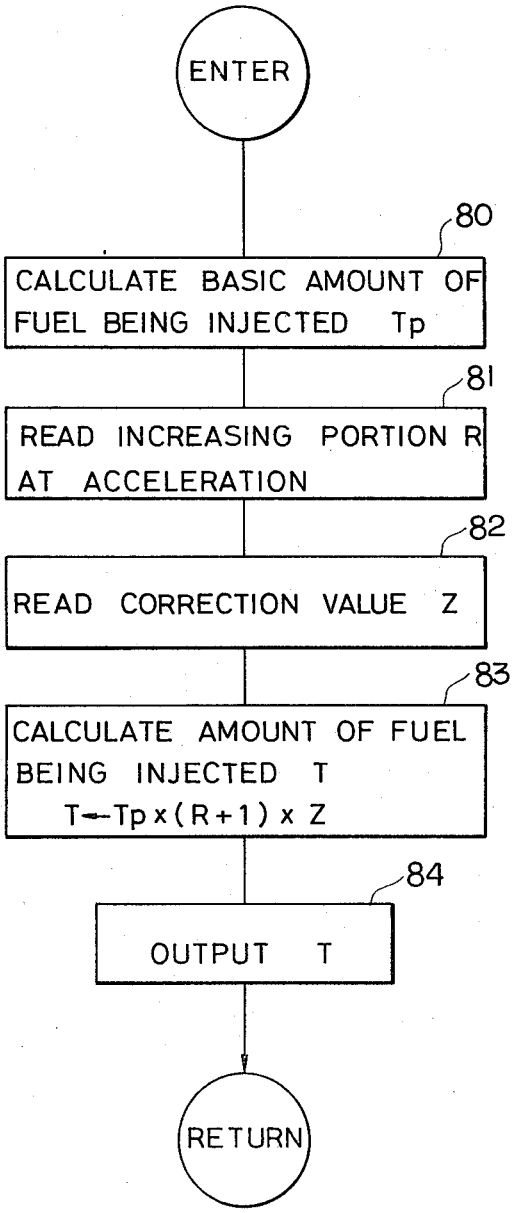
FIG. 8 is a flow diagram illustrative of the program for obtaining an amount of fuel being injected per cycle of injection by a fuel injection valve.

FIG. 8 is a flow diagram of a program for calculating an amount of fuel being injected per cycle of injection by the fuel injection valve 14.

A flow rate of intake air and a basic amount of fuel being injected Tp according to the rpm of the engine are calculated at a step 80. The value of increase R at the acceleration is read at a step 81. A correction value Z determined by the engine cooling-water temperature and a battery voltage is read at a step 82. At a step 83, an amount of fuel being injected is calculated according to an equation $Tp \times (R+1) \times Z$, where Tp·Z correspond to portions of fuel independent of the acceleration, and Tp·R·Z correspond to an increased portion at the acceleration, which portion has a relation to acceleration. At a step 84, the output representing the amount of fuel injected T is provided to the fuel-injection control circuit 68.

Figure 9:
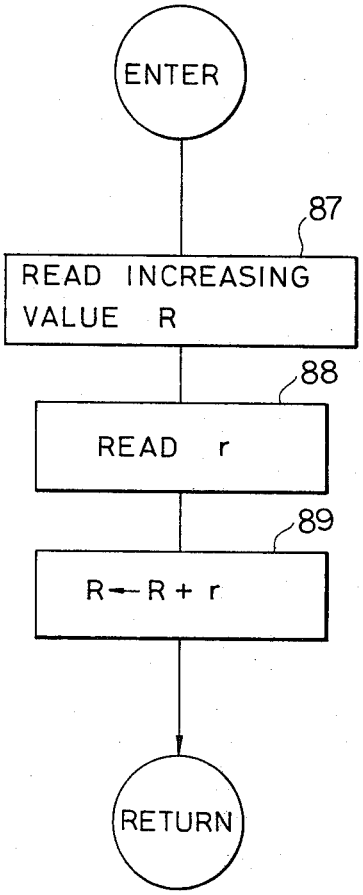
FIG. 9 is a flow diagram illustrative of the program interrupting for execution when an acceleration pulse is generated.

FIG. 9 shows an interrupt program which results from generation of the acceleration pulse P11. At a step 87, the value of increase R upon interruption is read. At a step 88, r is read. At a step 89, calculation by an equation $R+r$ is performed so that the result thereof is hereinafter used as a value of R.

Figure 10:
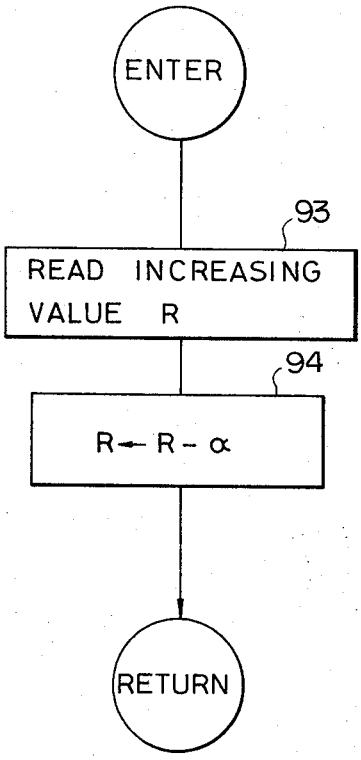
FIG. 10 is a flow diagram of the program interrupting for execution at intervals of a given duration of time.

FIG. 10 shows an interrupt program which occurs at intervals of 20 msecs. The priority of interruption of this program is low, as compared with that of the program of FIG. 9. At a step 93, a value of increase R upon interruption is read. At a step 94, calculation is performed by the equation $R-\alpha$, so that the result thereof is hereinafter used as R.

By the programs of FIGS. 9 and 10, there is provided the characteristic line representing the value of increase R versus time t as shown in FIG. 5. As the desired value of acceleration increases and as the engine temperature becomes low, an amount of fuel being supplied increases.

FIGS. 11 through 14 show another embodiment of the present invention. In this embodiment, the desired value of acceleration is detected by software.

Figure 11:
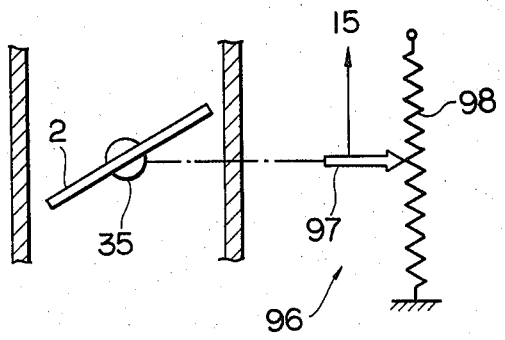
FIG. 11 shows a potentiometer which detects a position of the rotating throttle valve.
Figure 12:
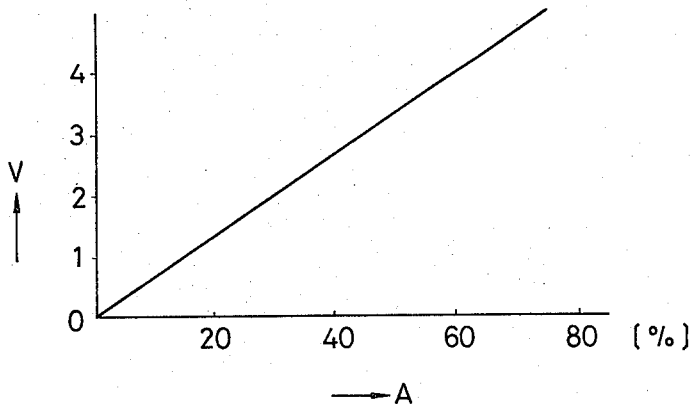
FIG. 12 is a graph representing the relationship of a degree of opening of the throttle valve versus the output of the potentiometer of FIG. 11.

FIG. 11 illustrates a potentiometer 96 for detecting a position to which the throttle valve 2 is turned. A sliding tap 97 of the potentiometer 96 is adapted to slide on a fixed resistor 98 in association with a position of the rotating rod 35 of the throttle valve 2.

Thus, a voltage V proportional to a degree of opening A of the throttle valve 2, as shown in FIG. 2, is obtained by the sliding tap 97 and fed to the electronically controlling fuel-injection circuit 15.

Figure 13:
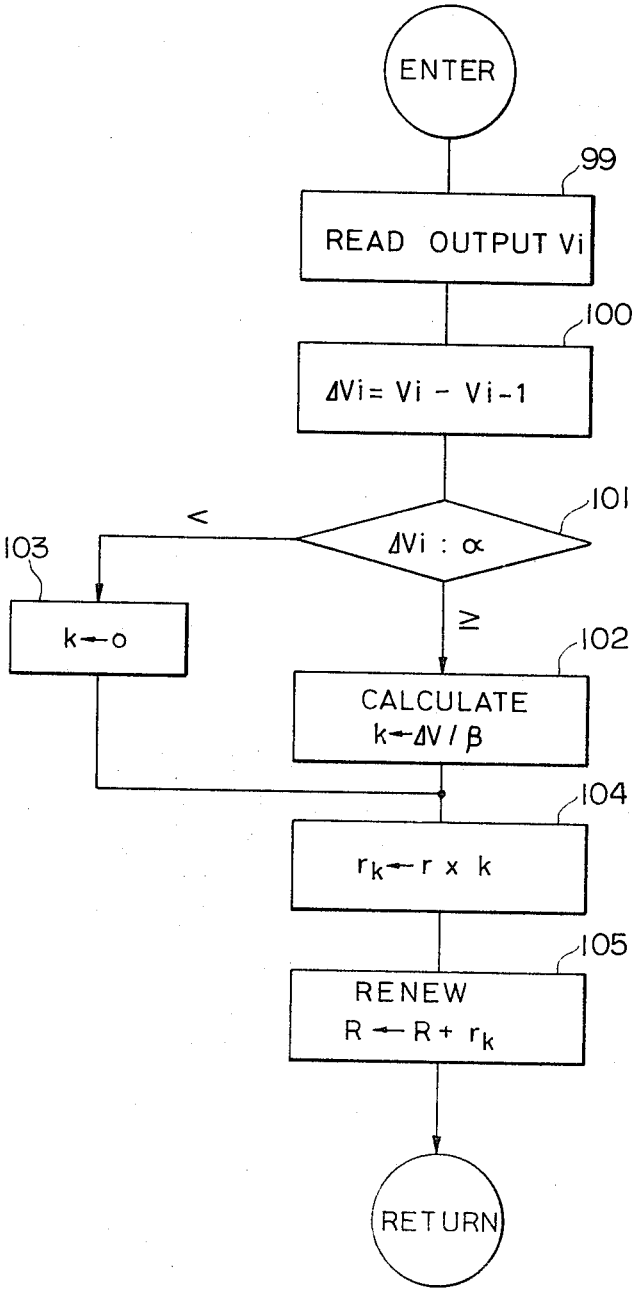
FIG. 13 is a flow diagram illustrative of the program for detecting a desired value of acceleration by utilizing the output of the potentiometer of FIG. 11.

FIG. 13 illustrates a flow diagram of the program interrupting at intervals of 10 msecs, in this embodiment. At a step 99 in this program, an output $V_i$ of the potentiometer 96 is read. At a step 100, an output $V_{i-1}$ in the former cycle is subtracted from the output $V_i$, and the result thereof is: $\Delta V_i(V_i - V_{i-1})$, where $V_{i-1}$ is an output at the former cycle. At a step 101, a comparison of $\Delta V_i$ with $\propto$ is made. If $\Delta V_i \geqq \alpha$, then a step 102 is executed, and at a step 102, calculation is performed by an equation $k = \Delta V_i/\beta$. If $\Delta V_i < \alpha$, then a step 103 is in turn executed, and at a step 103, $k=0$. At a step 104, $\gamma k = r \times k$ is obtained by calculation where r is identical with r selected in the manner shown in FIG. 6. At a step 105, the calculation $R + rk$ is performed and the result thereof is hereinafter used as R.

Figure 14:
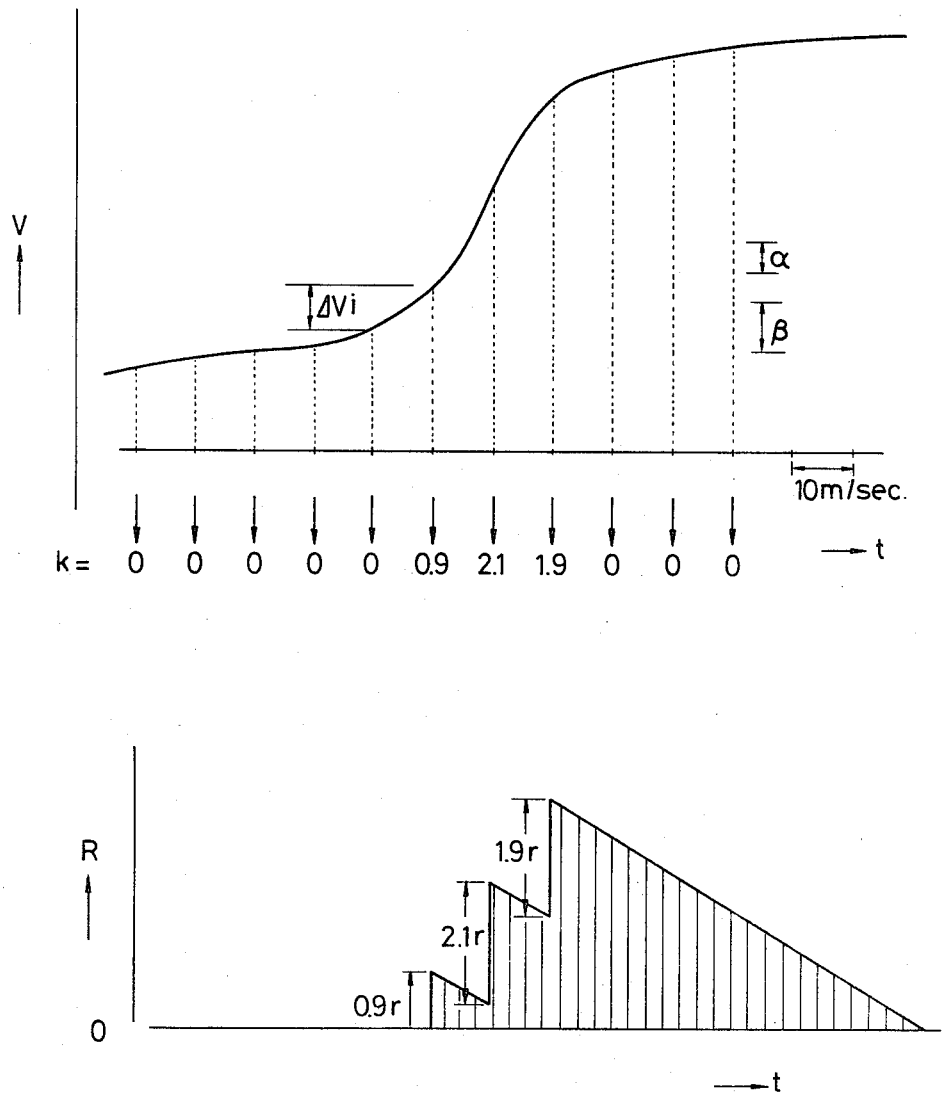
FIG. 14 is a graph representing, by way of example, the relationship between a value of increased portion calculated according to the program, the flow diagram of which is shown in FIG. 13, and the output of the potentiometer of FIG. 11; and, FIG. 15 illustrates in detail an air flow meter which is employed for detecting a desired value of acceleration.

FIG. 14 represents variation in an output V of the potentiometer 96. The value of k and the value of increase R vary as a function of the output V. If an output change $\Delta V$ measured after the lapse of 10 msecs. is less than $\alpha$, then k is zero. In terms of the output change $\Delta V$ being above $\alpha$, then the output change $\Delta V$ is divided into a portion of less than B and a portion of larger than B ($B > \alpha$). If the output change $\Delta V$ is less than $\beta$, then $\gamma k < r$. In this embodiment, a rising portion rk of the value of increase R at respective point of discontinuity increases as the throttle-valve opening speed increases.

Figure 15:
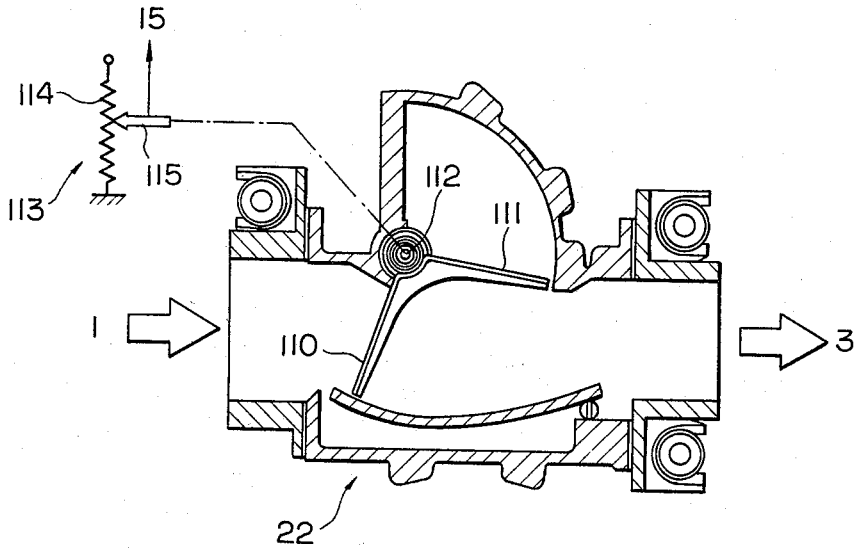

In order to detect the desired value of acceleration, the air flow meter 22 may be utilized. The air flow meter 22, as shown in FIG. 15, comprises a measuring plate 110 and a correction plate 111, which are formed integrally with each other and spaced apart a given angle from each other. The measuring plate 110 is rotated as a flow rate of intake air increases, until the force of the plate 110 counterbalances the force of a spring attached to a shaft 112. A variation in the position of rotating shaft 112 is transmitted to a sliding tap 115 adapted to slidingly move on a fixed resistor 114 of the potentiometer 113, so that a variation in a flow rate of intake air is transmitted as a voltage change to the electronically controlling circuit 15. Taking in view the fact that the larger the desired value of acceleration, the larger in change in a flow rate of intake air, a voltage which is detected by means of the sliding tap 115 is processed in like manner as the output voltage of the potentiometer 96 of FIG. 11 is, whereby the target value of acceleration is detected.

What is claimed is:

1. An electrically controlled, fuel injection method for an internal combustion engine, comprising the steps of:

generating an electric fuel signal related to a desired opening-duration of a fuel injection valve during a running mode of said engine;

transmitting said fuel signal to said valve, thereby controlling an amount of fuel being supplied into combustion chambers;

generating, on the basis of one of a throttle valve opening speed and a speed of increasing flow rate of air, at least one acceleration indication each time a commanded degree of acceleration exceeds a predetermined value independent of the position of a throttle valve in an intake system of said engine prior to a generation of said acceleration indication;

increasing a fuel amount increase value R by an incremental amount r in response to each acceleration indication independent of the previous fuel amount increase value R and independent of the rotational position of said engine;

decreasing said fuel amount increase value R with lapse of time;

changing said incremental amount r as a function of engine temperature; and increasing an amount of fuel being supplied during acceleration in the acceleration mode of the engine by altering said fuel signal by said fuel amount increase value R.

2. The method as defined in claim 1, wherein said changing step further comprises the step of increasing said incremental amount r as the temperature of said engine is lowered.

3. The method as defined in claim 2, wherein said acceleration indication generating step includes the step of monitoring changes in the degree of opening of said throttle valve to generate said acceleration indications.

4. The method as defined in claim 3, wherein said acceleration indication generating step further comprises the step of monitoring variations in voltage of a pair of conductors respectively having equally spaced plural comb-teeth, the plural comb-teeth of one conductor opposing in a staggered relation to the comb-teeth of the other conductor, so that a conductor portion moving integrally with a rod of said throttle valve comes into contact with these comb-teeth of the pair of conductors alternately when said throttle valve is turned to an open position, said variations in voltage in said pair of conductors being related to a commanded degree of acceleration.

5. The method as defined in claim 4, wherein said monitoring step further comprises the step of producing one of said acceleration indications only when a voltage at one of said pairs of conductors changes level and a voltage at the other conductor changes level within a predetermined time after said one conductor voltage changes level.

6. The method as defined in claim 5, wherein, said producing step further comprises the step of measuring said predetermined time with retriggerable monostable multivibrators.

7. The method as defined in claim 1 or 3 wherein said acceleration indication generating step further comprises the steps of:

generating with a potentiometer a voltage related to a position of a rotating rod of the throttle valve provided in an intake system; and detecting the degree of acceleration by monitoring the variation in an output of said potentiometer.

8. The method as defined in claim 7, wherein said detecting step further comprises the steps of detecting an output of said potentiometer at intervals of a given duration, and subtracting the output detected by a former cycle of detection from the output detected at a succeeding cycle of detection, said increasing step occurring only when a value greater than a predetermined value is obtained from said subtracting step.

9. The method according to claim 8, wherein:

said supplied fuel amount increasing step includes the step of increasing said amount of fuel injected per cycle of injection by said fuel-injection valve by an amount independent of acceleration and an amount which has a relation to acceleration; and said method further comprises the step of decreasing said amount of fuel after said injected fuel amount increasing step with a given gradient over time while said subtracting step produces a value below said predetermined value.

10. The method according to claim 9, wherein said supplied fuel amount increasing step further comprises the step of discontinuously increasing said amount of fuel by a given amount which has a relation to an engine temperature when said subtracting step produces a value above said predetermined value.

11. The method according to claim 10, wherein said discontinuously increasing step further comprises the step of increasing said amount of fuel by an amount proportional to the result obtained by said substracting step.

12. The method according to claim 1 or 2, wherein said acceleration indication generating step includes the step of detecting a degree of acceleration by monitoring a variation in a flow rate of intake air.

13. An electrical fuel injection control system for an internal combustion engine, said engine having at least one combustion chamber, a fuel injector controlled by a fuel injection valve for injecting fuel into said combustion chamber and a throttle valve for adjusting the amount of air supplied to said engine, comprising:

means for generating an electric fuel signal related to a desired opening-duration of said fuel injection valve during a running mode of said engine;

means for transmitting said fuel signal to said valve, thereby controlling an amount of fuel being supplied into said combustion chamber;

means for generating, on the basis of one of a throttle valve opening speed and a speed of increasing flow rate of air, at least one acceleration pulse each time a commanded degree of acceleration exceeds a predetermined value independent of the position of said throttle valve prior to generation of said acceleration pulse;

coordinating means for: (1) increasing a fuel amount increase value R by an incremental amount r in response to each acceleration pulse independent of the previous fuel amount increase value R and independent of the rotational position of said engine, (2) decreasing said fuel amount increase value R with lapse of time, and (3) changing said incremental amount r as a function of engine temperature; and means for increasing an amount of fuel being supplied during acceleration in the acceleration mode of the engine by altering said fuel signal by said fuel amount increase value R.

14. The system as defined in claim 13, wherein said coordinating means changing function increases said incremental amount r as the temperature of said engine is lowered.

15. The system as defined in claim 14, wherein a degree of acceleration is detected by a change in a degree of opening of said throttle valve.

16. The system as defined in claim 15, wherein said acceleration pulse generating means further comprises:

a pair of conductors respectively having equally spaced plural comb-teeth, the plural comb-teeth of one conductor opposing in a staggered relation to the comb-teeth of the other conductor;

a contact operatively coupled with a rod of said throttle valve and disposed to contact said comb-teeth of the pair of conductors alternately when said throttle valve is turned to an open position; and means for applying a voltage to said contact, variations in the voltage on said pair of conductors being related to a commanded degree of acceleration.

17. The system as defined in claim 16, wherein said acceleration pulse generating means generates an acceleration pulse only when a voltage at one of said pairs of conductors changes level and a voltage at the other conductor changes level within a predetermined time after said one conductor voltage changes level.

18. The system as defined in claim 17, wherein, said acceleration pulse generating means further comprises a retriggerable monostable multivibrator for measuring said predetermined time.

* * * * *